US007111767B2

(12) United States Patent
Losada

(10) Patent No.: US 7,111,767 B2
(45) Date of Patent: Sep. 26, 2006

(54) POWER ACTUATED FASTENER SYSTEM

(75) Inventor: Alfonso Losada, Bridgeport, CT (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

(21) Appl. No.: 09/729,389

(22) Filed: Dec. 4, 2000

(65) Prior Publication Data

US 2001/0000404 A1 Apr. 26, 2001

Related U.S. Application Data

(63) Continuation-in-part of application No. 09/403,109, filed as application No. PCT/US98/08060 on Apr. 15, 1998, now Pat. No. 6,273,316.

(60) Provisional application No. 60/046,826, filed on Apr. 24, 1997.

(51) Int. Cl.
*B25B 23/00* (2006.01)

(52) U.S. Cl. ..... 227/119; 227/136; 227/18

(58) Field of Classification Search ..... 227/8, 227/9, 10, 119, 136, 18, 109, 120, 135, 137, 227/147, 15, 17, 26, 31, 37, 50
See application file for complete search history.

(56) References Cited

U.S. PATENT DOCUMENTS 98,438 A 12/1869 Smith, Jr.
729,336 A 5/1903 Hass (Continued)

FOREIGN PATENT DOCUMENTS

AU 484427 8/1976

(Continued)

OTHER PUBLICATIONS

Inventor: Alfonso Losada, U.S. Appl. No. 60/423,826, filed on Nov. 5, 2002, 6 pages (printed both sides).

(Continued)

*Primary Examiner*—Stephen F. Gerrity
*Assistant Examiner*—Paul Durand
(74) *Attorney, Agent, or Firm*—Law Offices of James R. Cypher

(57) ABSTRACT

An automated power actuated gun having a fastener feeding track with guides for holding a fastener assembly having a plate and attached stud in a firing position. The power actuated gun is attached to the fastener feeding track so as to permit relative movement there between. A fastener loading control prevents movement of an adjacent fastener assembly held within the fastener feeding track from moving until the barrel of the power actuated gun is clear. The relative movement between the fastener feeding track and the power actuated gun is utilized to activate a control mechanism to perform various functions on the power actuated gun, such as to advance a charge or to push a trigger firing the power actuated gun. The functioning of the power actuated gun is automated, greatly increasing productivity of a worker and eliminating the need of the worker to tediously load by hand and fire individual fastener assemblies.

10 Claims, 14 Drawing Sheets

U.S. PATENT DOCUMENTS 1,213,970 A * 1/1917 Sturtevant ..... 227/147
1,476,836 A 12/1923 Pleister
2,298,560 A 10/1942 Harrison
2,417,245 A 3/1947 Eggert et al.
2,735,470 A 2/1956 Poupitch
2,768,552 A 10/1956 MacDonald
2,835,128 A 5/1958 Herrstrum
2,961,210 A 11/1960 Pfaff et al.
2,968,984 A 1/1961 De Caro
2,984,442 A 5/1961 Lawson
3,104,645 A 9/1963 Harrison
3,157,884 A * 11/1964 Decot et al. ..... 227/130
3,161,174 A 12/1964 Harrison
3,174,386 A 3/1965 Lewis
3,187,621 A 6/1965 Turner
3,212,388 A 10/1965 Rosselet
3,232,569 A 2/1966 Deardorf
3,285,120 A 11/1966 Kartiala
3,306,154 A 2/1967 Bailey
3,408,891 A 11/1968 Hartman
3,452,637 A 7/1969 O'Brien
3,469,492 A 9/1969 Dahl
3,476,010 A 11/1969 Markey
3,491,972 A 1/1970 Townshend
3,506,178 A * 4/1970 Brunelle ..... 227/10
3,554,246 A 1/1971 Halstead
3,602,976 A 9/1971 Grube
3,633,810 A 1/1972 Krakauer et al.
3,638,892 A 2/1972 Boye et al.
3,728,933 A 4/1973 Grube
3,734,377 A 5/1973 Munn
3,828,925 A 8/1974 Magyar et al.
3,845,860 A 11/1974 Ladouceur et al.
3,921,495 A 11/1975 Braun et al.
3,948,141 A 4/1976 Shinjo
4,000,681 A 1/1977 Coldren
4,014,488 A 3/1977 Potucek et al.
4,020,734 A 5/1977 Bell
4,037,515 A 7/1977 Kesselman
4,037,516 A 7/1977 Hart
4,047,463 A 9/1977 Coldren
4,062,388 A * 12/1977 DeCaro ..... 227/10
4,102,238 A 7/1978 Thurner
4,149,446 A 4/1979 Spengler et al.
4,246,939 A * 1/1981 Boegel ..... 227/136
4,287,656 A 9/1981 Gassman et al.
4,303,001 A 12/1981 Trungold
4,339,065 A 7/1982 Haytayan
4,370,082 A 1/1983 Sundberg
4,389,012 A * 6/1983 Grikis et al. ..... 221/198
4,424,929 A * 1/1984 Weis ..... 227/32
4,479,599 A * 10/1984 Conrad ..... 227/156
4,485,952 A * 12/1984 Weis ..... 227/7
4,494,412 A 1/1985 Hardy
4,655,423 A 4/1987 Schavilje et al.
4,684,022 A 8/1987 Potucek
4,703,711 A 11/1987 Haynes
4,703,883 A 11/1987 Losada
4,709,842 A 12/1987 Westerlund
4,729,703 A 3/1988 Sato
4,736,923 A 4/1988 Losada
4,824,003 A 4/1989 Almeras et al.
4,870,750 A 10/1989 Zahn
4,887,948 A 12/1989 Calmettes
4,889,457 A 12/1989 Hageman
4,903,831 A 2/1990 Francis
4,907,928 A 3/1990 Beck et al.
4,915,561 A 4/1990 Buhri et al.
4,930,623 A 6/1990 Johnson et al.
4,930,673 A * 6/1990 Pfister ..... 227/10
4,932,819 A 6/1990 Almeras
4,936,843 A 6/1990 Sohngen
4,979,857 A 12/1990 Wing
5,015,132 A 5/1991 Turner et al.
5,052,607 A 10/1991 Dutton
5,110,247 A 5/1992 Losada
5,135,152 A 8/1992 Uno et al.
5,144,870 A 9/1992 Nick
5,178,503 A 1/1993 Losada
5,199,625 A 4/1993 Dewey et al.
5,199,835 A 4/1993 Turner
5,228,250 A 7/1993 Kesselman
5,261,770 A 11/1993 Hoepker et al.
5,292,216 A 3/1994 Van Allman
5,328,300 A 7/1994 Fischer et al.
5,370,483 A 12/1994 Hood et al.
5,417,534 A 5/1995 Losada
5,425,488 A 6/1995 Thompson
5,443,345 A 8/1995 Gupta
5,452,835 A 9/1995 Shkolnikov
5,479,830 A 1/1996 Gemra
5,487,632 A 1/1996 Hood et al.
5,497,929 A 3/1996 Armstrong
5,525,018 A 6/1996 Losada
5,554,131 A 9/1996 Lacivita
5,568,753 A * 10/1996 Habermehl et al. ..... 227/136
5,579,975 A * 12/1996 Moorman ..... 227/119
5,597,972 A * 1/1997 Wachter ..... 227/10
5,624,200 A 4/1997 Beaulieu
5,634,583 A 6/1997 McGuinness et al.
5,634,756 A 6/1997 Losada
5,669,589 A 9/1997 Janssen et al.
5,697,431 A 12/1997 Nagasaka
5,704,572 A 1/1998 Vogel et al.
5,758,465 A 6/1998 Logue
5,769,581 A 6/1998 Wallace et al.
5,773,722 A 6/1998 Helderman
5,788,444 A * 8/1998 Losada ..... 411/441
5,810,239 A * 9/1998 Stich ..... 227/119
5,829,661 A * 11/1998 Hirtl et al. ..... 227/10
5,885,034 A 3/1999 Fergusson
5,890,857 A 4/1999 Herrera
5,897,082 A 4/1999 Losada
5,913,647 A 6/1999 Hodge
5,931,618 A 8/1999 Wallace et al.
6,055,891 A 5/2000 Habermehl
6,273,316 B1 8/2001 Losada
6,296,166 B1 10/2001 Huang
6,481,611 B1 11/2002 Losada
6,685,078 B1 2/2004 Wohlwend et al.
6,761,299 B1 7/2004 Caringella et al.

FOREIGN PATENT DOCUMENTS

| | | |
|---|---|---|
| AU | 743441 | 11/1998 |
| BE | 0518452 | 3/1953 |
| DE | 1603703 | 9/1970 |
| DE | 2504816 | 8/1975 |
| EP | 0 100 555 | 2/1984 |
| FR | 1047890 | 12/1953 |
| GB | 194 | 2/1898 |
| GB | 1 384 511 | 2/1975 |
| GB | 2 195 453 A | 4/1988 |
| GB | 2 229 242 A | 9/1990 |
| JP | 46-1521 | 1/1971 |
| WO | WO 97/29288 | 8/1997 |
| WO | WO 98/47668 | 10/1998 |

OTHER PUBLICATIONS

Inventor: Alfonso Losada, U.S. Appl. No. 60/419,768, filed on Oct. 18, 2002, 6 pages (printed both sides).

Inventor: Alfonso Losada, U.S. Appl. No. 10/043,669, filed on Jan. 11, 2002, 14 pages (printed both sides).
Inventor: Alfonso Losada, U.S. Appl. No. 10/703,223, filed on Nov. 5, 2003, total of 17 pages.
Inventor: Alfonso Losada, U.S. Appl. No. 10/687,680, filed on Oct. 17, 2003, total of 20 pages.
Hydrajaws Limited, "Portable Tension Tester," Hydrajaws Testing Division, Rotadex Systems Limited (Birmingham, U.K.), total of 4 pages, (at least as early as Mar. 6, 2000).
Beth-Fast, "Direct Tension Indicators," Beth-Fast (U.S.A.), total of 6 pages, (at least as early as Feb. 29, 2000).
Applied Bolting Technology Products, Inc., "Applied Bolting Technology," the best way to bolt . . . Direct Tension Indicators for Bolting Quality Assurance, Applied Bolting Technology Products, Inc. (Ludlow, VT), total of 12 pages.
Gary R. Harris, "Hold Down System Using Calibrated Compression," (Oakland, California), total of 19 pages.
Salon Conical Compression Washers, "On Washer," total of 2 pages.
Grosby G-318 Tension Indicator, "Tumbuckes and Tension Indicator," p. 29.

* cited by examiner

POWER ACTUATED FASTENER SYSTEM

RELATED APPLICATIONS

This application claims the benefit of U.S. application Ser. No. 60/046,826 filed Apr. 24, 1997.

This application is a continuation in part of U.S. application Ser. No. 09/403,109, filed Oct. 14, 1999, now U.S. Pat. No. 6,273,316, which is the National State of an International Application No. PCT/US98/08060 having an international filing date of Apr. 15, 1998. U.S. application Ser. No. 09/403,109, filed Oct. 14, 1999, also having been divided, resulting in U.S. application Ser. No. 09/875,488, filed Nov. 19, 2002, now U.S. Pat. No. 6,481,611.

FIELD OF THE INVENTION

The present invention relates generally to power actuated fasteners used in construction, and particularly to an automated power actuated fastener tool with track feeding.

BACKGROUND OF THE INVENTION

Power actuated guns are frequently used in construction. The power actuated guns are used to fasten building materials to a hard surface. Power actuated guns generally use a powder charge or a cartridge to drive a nail or a stud with great force into a hard surface, such as cement. Fasteners are often used that are comprised of a shaped plate with a nail or stud placed there through. Often, an angled plate having a hole therein is used so that a wire or other device can be fastened thereto. An example of a fastener which is used with a power actuated gun is disclosed in U.S. Pat. No. 4,736,923 entitled "Fastener Assembly" issuing to Losada on Apr. 12, 1988, which is herein incorporated by reference. Power actuated fastener guns have been used in combination with the fastener assemblies. The stud or nail of the fastener assembly is placed within the barrel of the power actuated gun and placed adjacent a hard surface. The power actuated gun is then fired driving the stud or nail into the hard surface. Often, the fasteners will be used in ceiling applications with the power actuated gun being placed on a pole, the fastener assembly being inserted within the bore of the power actuated gun and the whole device raised to the ceiling with the pole. When pressure is applied to the pole, the power actuated gun fires, driving the nail or stud into the hard surface. The power actuated gun is then lowered for insertion of another fastener assembly. Often, it is also necessary to cock the gun or to advance the powder charge to render the gun operable for another firing. While this operation is satisfactory for many applications, it also requires a great deal of time to manually load each fastener assembly prior to firing the power actuated gun. Therefore, there is a need to improve and make more productive the use of power actuated guns and fastener assemblies so as to increase their efficiency and make each worker more productive. Increases in productivity are essential in the construction field where ever escalating labor costs make it essential that each worker as productive as possible. Therefore, there is a continuing need to increase the productivity of each worker and to automate the construction process as much as possible. One system that has greatly advanced the power actuated gun art is disclosed in U.S. patent application Ser. No. 09/403,109 filed Oct. 14, 1999 and entitled "Fastener Feeding System For Power Actuated Gun" invented by Losada, which is herein incorporated by reference. While this device has dramatically improved the productivity of workers, there is a need for yet further improvement.

SUMMARY OF THE INVENTION

In one embodiment of the present invention, a feeding system for use with a power actuated gun comprises a track to hold a plurality of fastener assemblies having guides for positioning a fastener assembly over a surface and to be received by the barrel of a power actuated gun. Once in position and held by the guides, the power actuated gun is moved relative to the feeding system, causing the guide to release the fastener assembly and the fastener assembly to be driven into a surface upon the firing of the power actuated gun.

In another embodiment of the present invention, a fastener loading control is used to prevent a fastener assembly adjacent the fastener assembly in position for firing from advancing prematurely.

In another embodiment of the present invention, the relative movement between the power actuated gun and an attachment is used to control various operations of the power actuated gun. In one embodiment, the relative movement is used to advance the charge on a strip, making the power actuated gun ready for another firing. In another embodiment, the relative movement is used to activate a trigger so as to fire the power actuated gun when the fastener assembly is in position.

In another embodiment, a stop is used to prevent the power actuated gun from firing when a fastener is not in position.

Accordingly, it is an object of the present invention to make laborers or workers more productive and thereby reduce construction costs.

It is another object of the present invention to provide a power actuated fastening system that has a smooth operation and is easy to use.

It is a further object of the present invention to use the relative movement between a power actuated gun and an attachment to automate various functions.

It is a further object of the present invention to provide a power actuated fastener system that is safe to use.

It is an advantage of the present invention that it saves time.

It is a further advantage of the present invention that the relative movement between the power actuated gun and an attachment is used to automate many different functions.

It is another advantage of the present invention that the power actuated gun cannot be fired unless a fastener assembly is in the proper firing position.

It is a feature of the present invention that a track holds a plurality of fastener assemblies.

It is a further feature of the present invention that a fastener loading control prevents the advancement of a fastener assembly within the track until the adjacent fastener assembly is cleared.

It is another feature of the present invention that a rod and spring provides relative movement between the power actuated gun and an attachment.

It is yet another feature of the present invention that a stop is used to prevent the firing of the power actuated gun without a fastener assembly being in the proper firing position.

These and other objects, advantages, and features will become readily apparent in view of the following more detailed description.

DETAILED DESCRIPTION OF THE PREFERRED EMBODIMENTS

Figure 1:
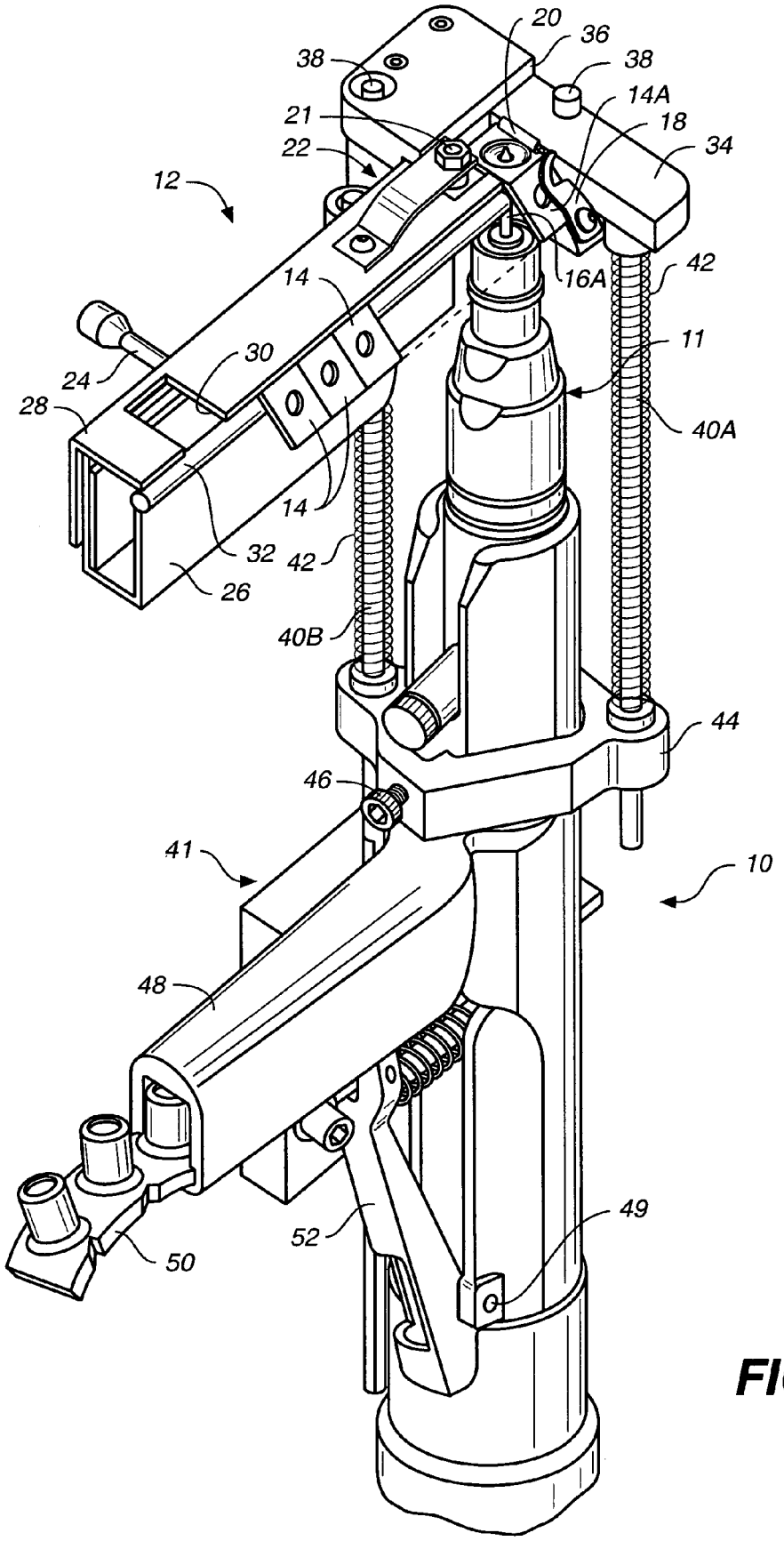
FIG. 1 is a perspective view of an embodiment of the present invention.

FIG. 1 illustrates an embodiment of the present invention. A power actuated gun or tool 10 is illustrated. The power actuated gun 10 may be based on any commercially available power actuated gun. Generally, there are several different types of operation of power actuated guns. For example, some power actuated guns may have to be cocked, some may fire when pressure is applied to the rear of the gun, some may require the pulling of a trigger to fire the gun, and some may require the charge to be manually advanced. The present invention may be adapted to any of a variety of these commercially available power actuated guns. Additionally, many power actuated guns may be modified in accordance with the teachings of the present invention in order to improve the power actuated gun. A fastener feeding track 12 is attached to the body of the power actuated gun 10 so as to be positioned over a barrel 11. The fastener feeding track 12 contains a plurality of fastener assemblies comprising a fastener plate 14 with a nail or a stud 16A frictionally fastened to the fastener plate 14 though an aperture formed therein. A fastener assembly placed within a channel in the fastener feeding track 12 is advanced forward into a position over the barrel 11. A rear guide 18 is made of a spring metal that holds a portion of a positioned fastener plate 14A. A side guard 20 also made from spring steel contacts a side of the positioned fastener plate 14A, holding it into position over barrel 11. Guides 18 and 20 only illustrate one means for holding the fastener assembly in position. A fastener loading control 22 is positioned adjacent the fastener assembly plate 14A in position over the barrel 11 and is used to control the loading of the next adjacent fastener assembly plate 14 into position once the gun 10 is fired. The fastener assembly loading control 22 prevents an adjacent fastener assembly plate 14 from prematurely advancing into position before the barrel 11 of the power actuated gun is in position to receive another fastener assembly. Lever 24 having a coiled spring attached, not shown, biases the plurality of fastener assembly plates 14 down the track 12, forcing the fastener assemblies into position sequentially over the barrel 11. The track 12 comprises a channel piece 26 with an angled piece 28. An opening 30 is formed within the angled piece 28. A radius slide 32 is attached to the channel piece 26 and aids in the sliding of the plates 14 along the track 12. A support plate 34 has a spacer plate 36 attached thereto. Formed on the spacer plate 36 and the support plate 34 are feet 38. Contact 21, forming a part of the fastener loading control 22, may also act as a support or foot so as to provide three points of contact when the track 12 is placed adjacent a surface. A short rod 40A has a spring 42 surrounding it. Short rod 40A is slidably held within a collar 44. Short rod 40A has an end fixed to the support plate 34. A long rod 40B is attached to another portion of the track 12 and similarly has a spring 42. One end of the long rod 40B is slidably attached to collar 44. The distal end of the long rod 40B is attached to a control mechanism 41. The positioning of the track 12 and the tension within the spring 42 may be adjusted by axially sliding collar 44 on the body of the power actuated gun 10. The position of the collar 44 may be locked into place by set screw 46. A fixed handle 48 contains therein a charge strip 50. Charge strip 50 contains a plurality of powder charges that are used to drive the fastener assembly. A charge advance lever 52 is pivoted by pivot 49 and is used to advance the charge strip 50. From FIG. 1, the general operation of this embodiment of the present invention should be appreciated. A plurality of fastener assemblies, including plate 14, are inserted through opening 30 and slid down the channel piece 26 while lever 24 is drawn rearward or away from the barrel 11 of the power actuated gun 10. After a plurality of fastener assemblies have been inserted through opening 30 and slid down the track 12, lever 24 may be released causing an end plate, not illustrated, to contact the last fastener assembly, forcing it against adjacent fastener assemblies until a fastener assembly is placed in a firing position adjacent the support plate 34. The guides 18 and 20 retain the fastener assembly in the firing position. After placing the track 12 adjacent a surface through which the fastener assembly is to be driven, the power actuated gun is forced upward or towards the track 12 so as to cause the stud 16A to enter the barrel 11. The plate 14A, it is pushed through the guides 18 and 20 so as to cause the fastener assembly to be securely forced against the surface into which it is to be driven. The application, in this particular power actuated gun, of additional force causes the gun to automatically fire. Upon release of pressure from the rear of the power actuated gun 10, the springs 42 cause the barrel 11 to move away from the track assembly 12. However, the fastener loading control 22 prevents a fastener assembly from advancing within the channel piece 26 until after the barrel 11 is withdrawn a sufficient distance and the contact 21 and feet 38 are removed a predetermined distance from the surface. The control mechanism 41 then causes the lever 52 to be depressed, advancing the charge strip 50. The gun is now ready for another firing with another fastener assembly secured positioned in a firing position.

Figure 2:
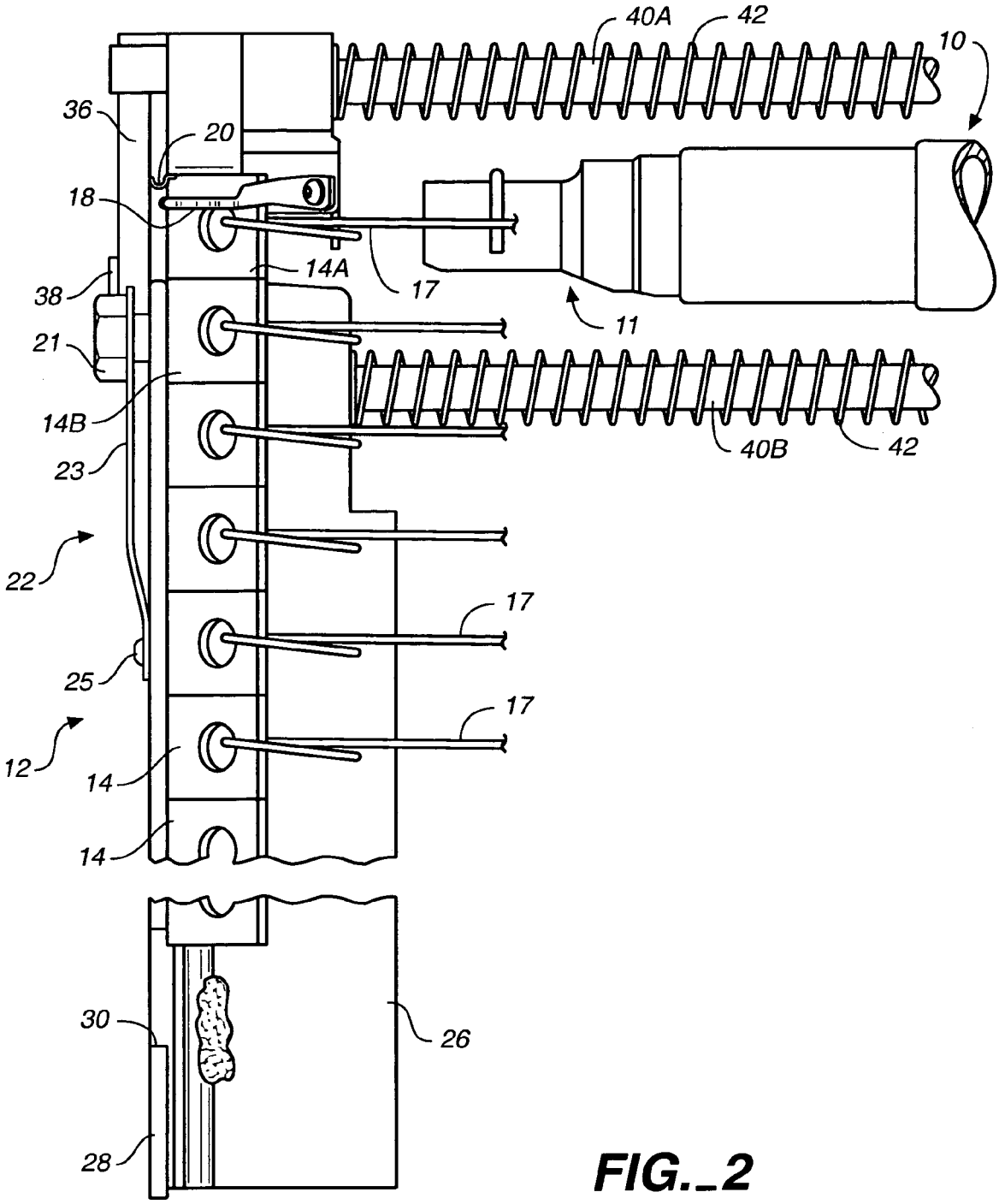
FIG. 2 is a side elevational view of an embodiment of the present invention.

FIG. 2 more clearly illustrates the track 12 and the fastener loading control 22. The plurality of fastener assemblies have a plurality of shaped plates 14 that abut one another. Additionally, wires 17 are shown attached to plates 14. A particularly prevalent application of power actuated guns is to hang wire assemblies from ceilings, such that objects may be attached to the wires 17 and suspended or supported, for example a suspended ceiling. Guides 18 and 20 hold plate 14A of the fastener assembly into position over barrel 11. Plate 14B of adjacent fastener assembly is held in position by fastener loading control 22. The fastener loading control 22 comprises a contact 21 which is positioned adjacent a surface, forcing it toward the angled plate 28 and fastener plate 14B. Spring 23 normally biases the contact 21 away from the top surface of the angled plate 28. A screw 25 holds one end of the spring 23 onto a surface of the angled plate 28 while the distal end of the spring 23 has contact 21 attached thereto. Accordingly, the adjacent fastener assembly having plate 14B is prevented from advancing until spring 23 biases contact 21 upward to release the plate 14B. This assures that the plate 14B is not advanced until after the barrel 11 is retracted or biased away from the channel 26 by springs 42. Only after barrel 11 is sufficiently clear is the plate 14B released to advance into a firing position.

Figure 3A:
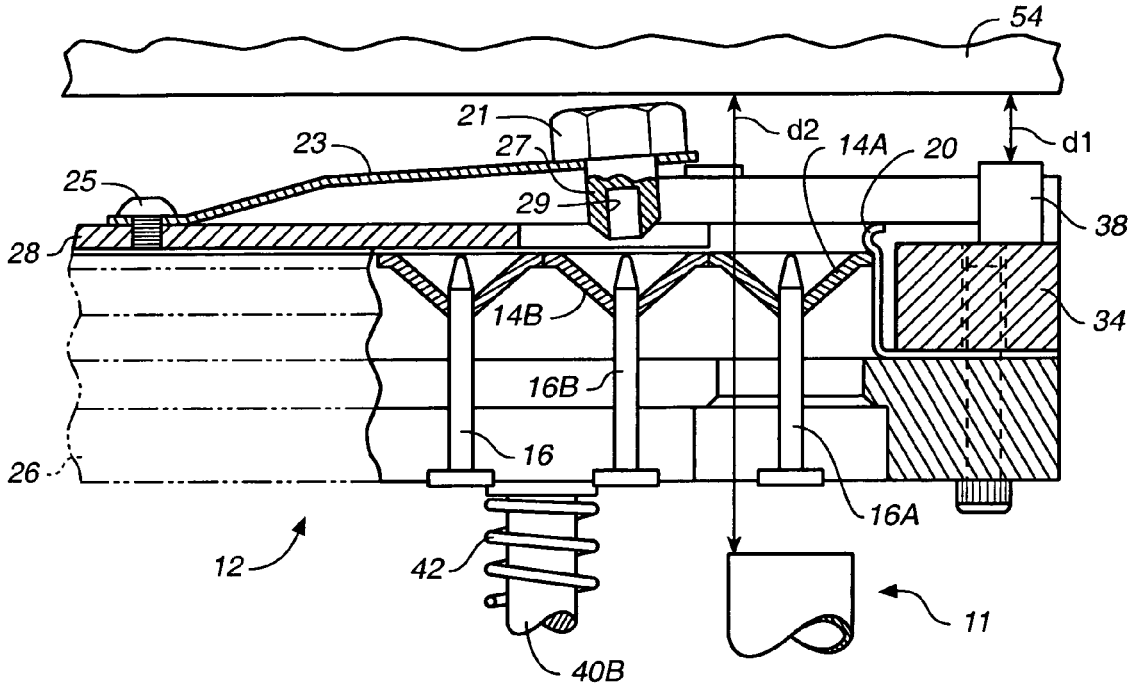
FIG. 3A is a partial cross section of an embodiment of a fastener loading control in a first position.
Figure 3B:
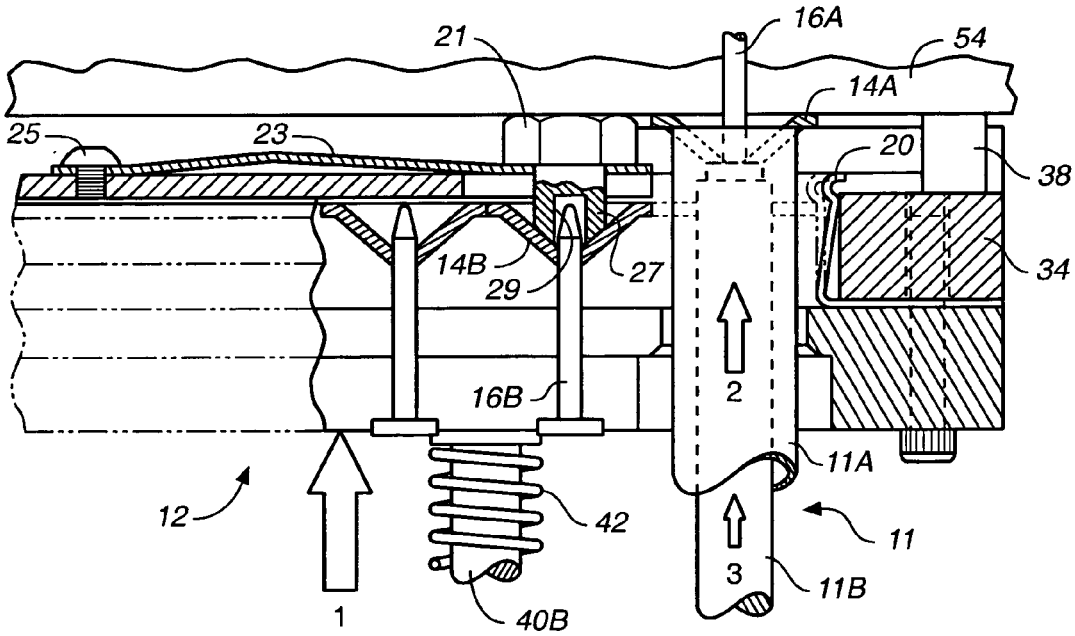
FIG. 3B is a partial cross section of an embodiment of a fastener loading control in a second position.

FIGS. 3A and 3B more clearly illustrate the operation of the fastener loading control 22. As the track 12 is placed adjacent a hard surface 54 and the distance $d_1$ between the foot 38 and the hard surface 54 is reduced, the contact 21 also contacts the hard surface 54 causing extension 27 downward towards stud 16B. As the extension 27 moves downward, the point of stud 16B enters space 29 within the extension 27. Accordingly, when distance $d_1$ between the surface 54 and the foot 38 is reduced and the foot 38 contacts the surface 54, the distance $d_2$ between barrel 11 and the surface 54 is then reduced and the barrel 11 advances. Accordingly, as is illustrated in FIG. 3B, as the track 12 moves in the direction of arrow 1 and the foot 38 contacts the surface 54, the outer barrel 11A contacts plate 14A, stripping the plate 14A from the guide 20. The extension 27 engulfs the point of shaft 16B, securely holding the adjacent plate 14B in position. After the fastener assembly and plate 14A are firmly against surface 54, the inner plunger 11B is forced downward in the direction of arrow 3 by an explosive charge so as to drive the stud 16A within the hard surface 54. After firing, the inner plunger 11B and the outer barrel 11A are withdrawn away from the surface 54. Once the barrel 11 is withdrawn a sufficient distance and the power actuated gun is continued to be withdrawn from the surface 54 such that a gap forms between the surface 54 and foot 38, the contact 21 will then be biased upward or away by spring 23, causing release of the adjacent stud 16B. Once the stud 16B is released, the adjacent fastening assembly and the plate 14B is advanced to the firing position over barrel 11.

Figure 3C:
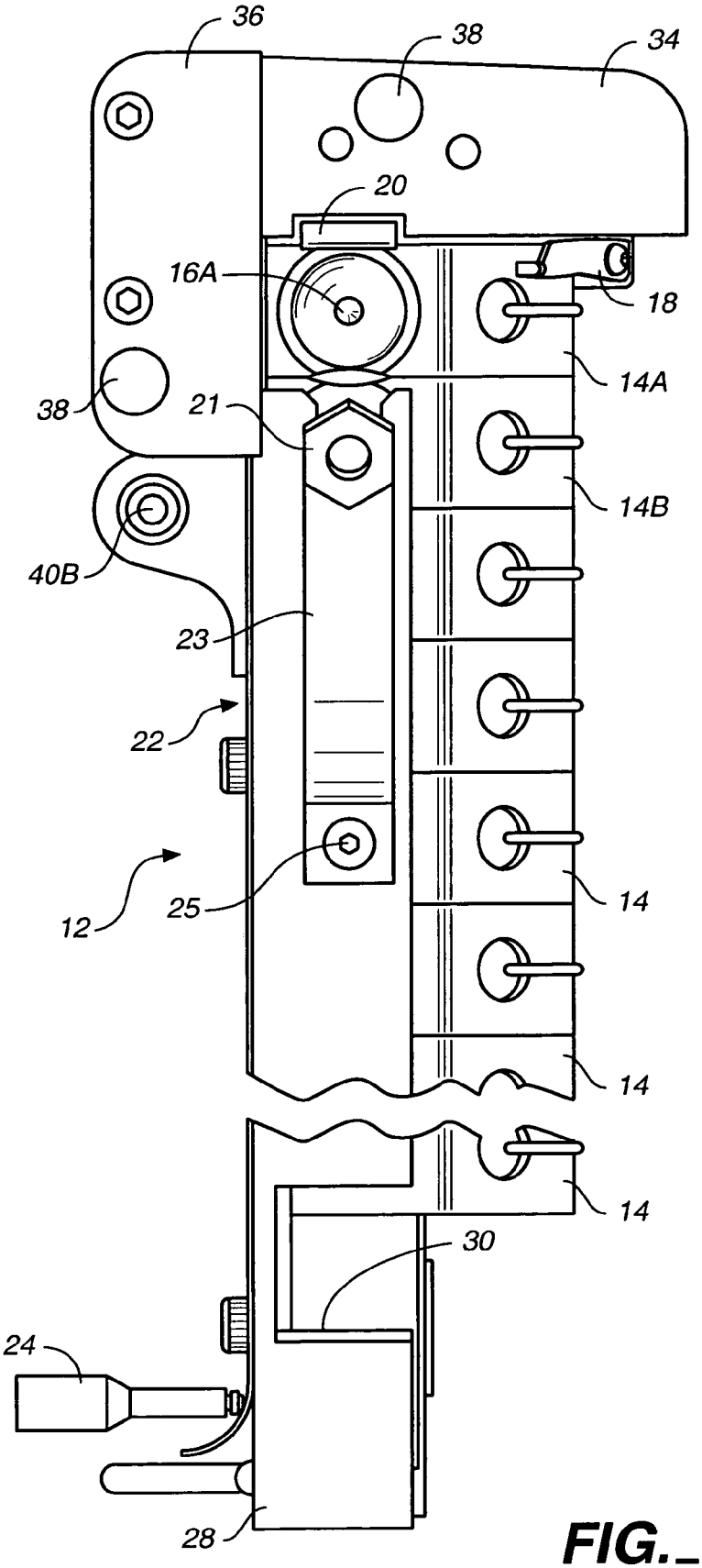
FIG. 3C is a plan view of an embodiment of the present invention.

FIG. 3C is a plan view illustrating the surface of the track 12 and the holding of plate 14A. Plate 14A of the fastener assembly can clearly be seen in a position held by guides 18 and 20 and an adjacent fastener assembly having plate 14B. The fastener loading control 22 can also more clearly be seen. Each plate 14 advances the adjacent plate 14 down the track 12 as respective fastener assemblies are driven into a surface with the power actuated gun.

Figure 4A:
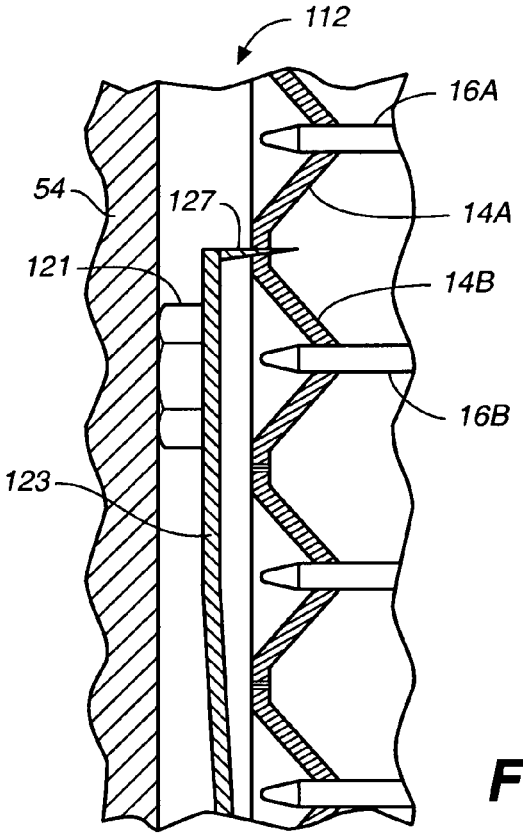
FIG. 4A is a partial cross section of another embodiment of a fastener loading control.
Figure 4B:
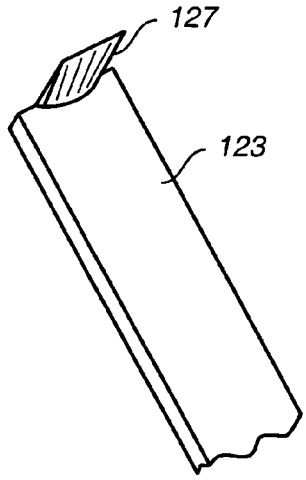
FIG. 4B is a partial perspective view of the fastener loading control embodiment illustrated in FIG. 4A.

FIGS. 4A and B illustrate another embodiment of a fastener loading control. In this embodiment, when a surface 54 contacts contact 121 forcing an extension 127 downward, the extension 127 is forced between plate 14A and adjacent plate 14B. Accordingly, plate 14B is prevented from moving toward the firing position until after the biasing force in spring 123 forces the contact 121 away from the fastener assemblies as the track is removed from the surface 54.

Figure 5A:
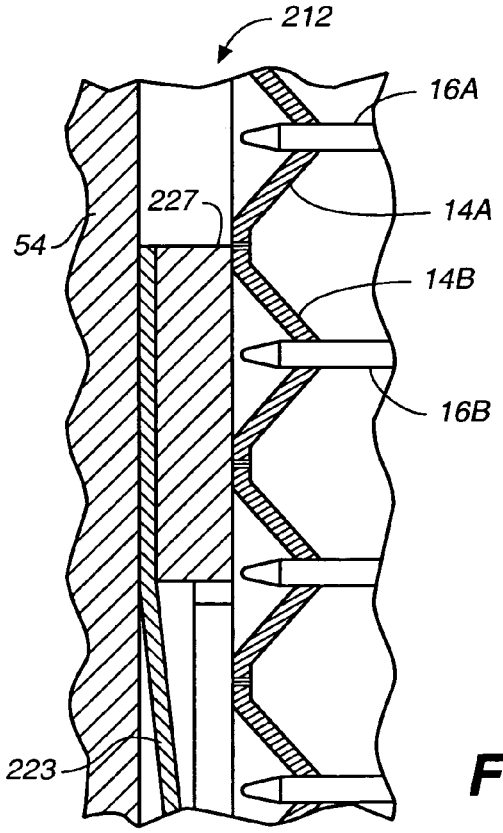
FIG. 5A is a partial cross section of another embodiment of a fastener loading control.
Figure 5B:
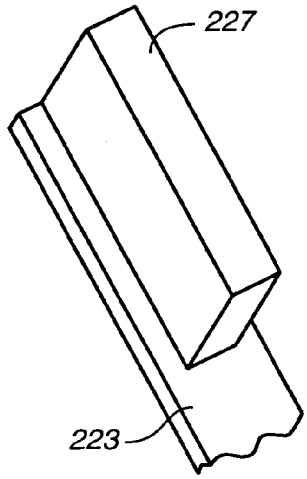
FIG. 5B is a partial perspective view of the fastener loading control embodiment illustrated in FIG. 5A.

FIGS. 5A and B illustrate another embodiment of a fastener loading control. In this embodiment, surface 54 forces a block extension 227 adjacent portions of plate 14B as track 212 is placed in position adjacent surface 54. Friction then retains the plate 14B in position, preventing it from advancing forward as the fastener assembly and plate 14A are driven into surface 54. Upon removal of the track 212 from the surface 54, the biasing force in spring 223 forces the block extension 227 away from the track 212 and thereby releases the fastener assembly having plate 14B. The plate 14B is then free to advance into the firing position. Clearly, other equivalent fastener loading control devices are possible. For example, each fastener plate may have hole therein through which an extension can be inserted preventing unintentional movement of the fastener plate.

Figure 6A:
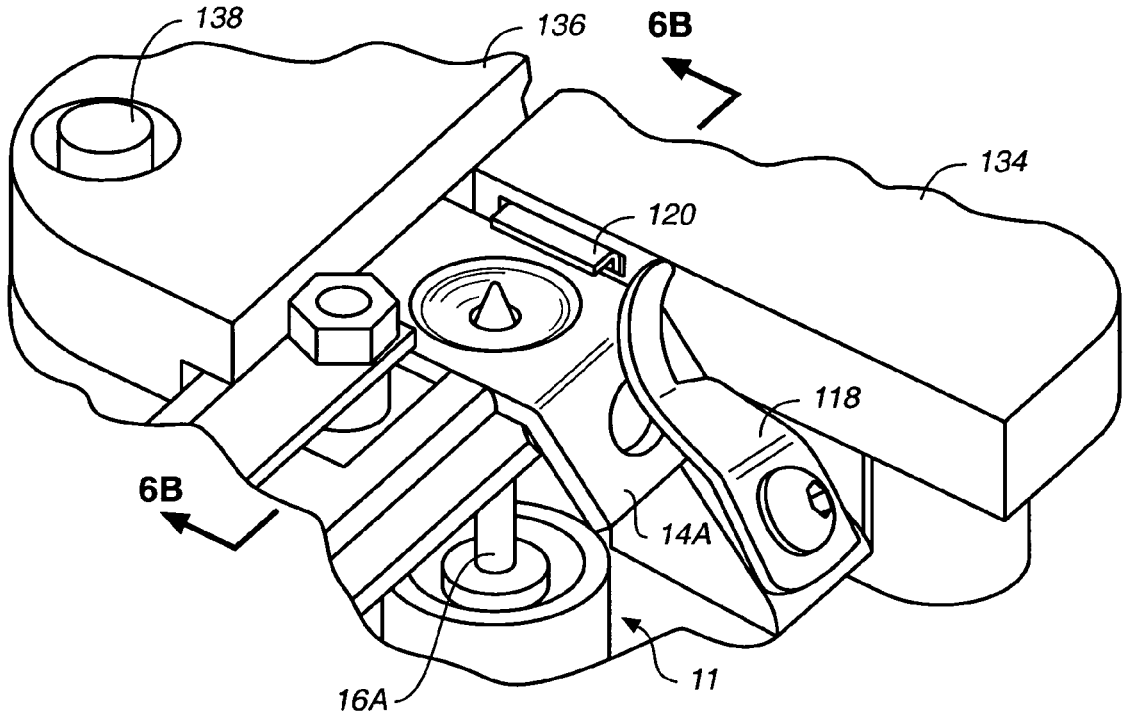
FIG. 6A is a perspective view of a portion of another embodiment of the present invention.
Figure 6B:
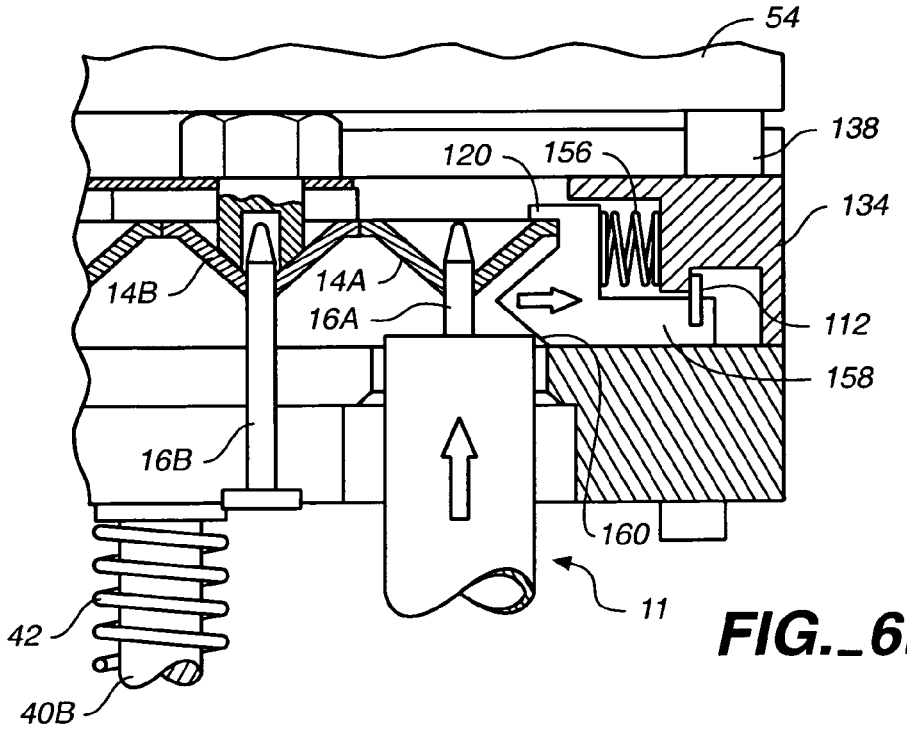
FIG. 6B is a cross section taken along line 6B—6B in FIG. 6A.

FIGS. 6A and B illustrate another guiding mechanism used in holding plate 14A of a fastener assembly in a firing position over barrel 11. In this embodiment, a support plate 134 houses a cam driven side guide 120. Support plate 134 is attached to a spacer plate 136, which has a foot 138 thereon. A rear guide 118 holds the angled portion of plate 14A. FIG. 6B is a partial cross section taken along line 6B—6B in FIG. 6A. FIG. 6B more clearly illustrates the operation of the cam driven side guide 120. A spring 156 forces a guide slide 158 towards plate 14A. Stop 162 prevents the guide slide 158 from being forced out of the support plate 134. Accordingly, when plate 14A is in a firing position, it is retained between the guide 120 and an adjacent plate 14B. As the barrel 11 is moved adjacent the plate 14A in the direction of the arrow on barrel 11, nail or stud 16A enters the barrel 11 and a corner of barrel 11 contacts cam surface 160 on the guide slide 158. The guide slide 158 is forced in the direction of the arrow on the guide slide 158 against the bias force of spring 156. The guide 120 is then caused to release the plate 14A while the stud 16A is securely retained within the barrel 11. The plate 14A of the fastener assembly is then free to be moved against the surface 54 and driven therein.

Figure 7A:
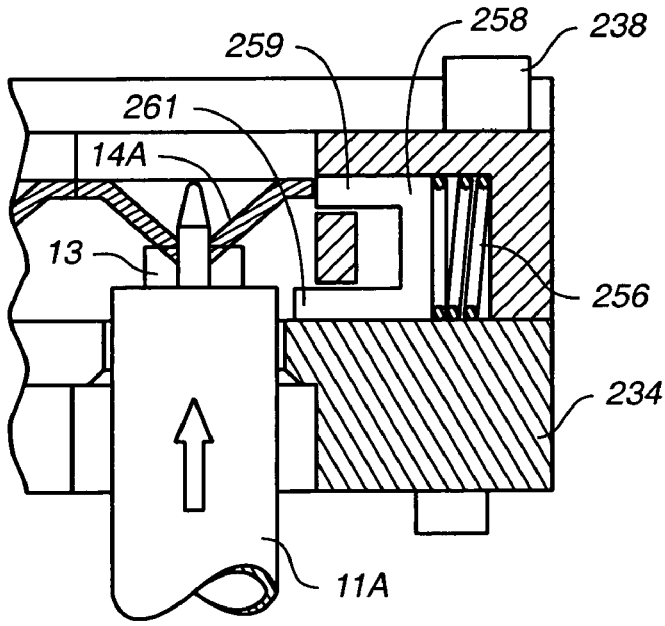
FIG. 7A is a partial cross section of another embodiment of the present invention illustrating the operation of a firing safety device in a first position.
Figure 7B:
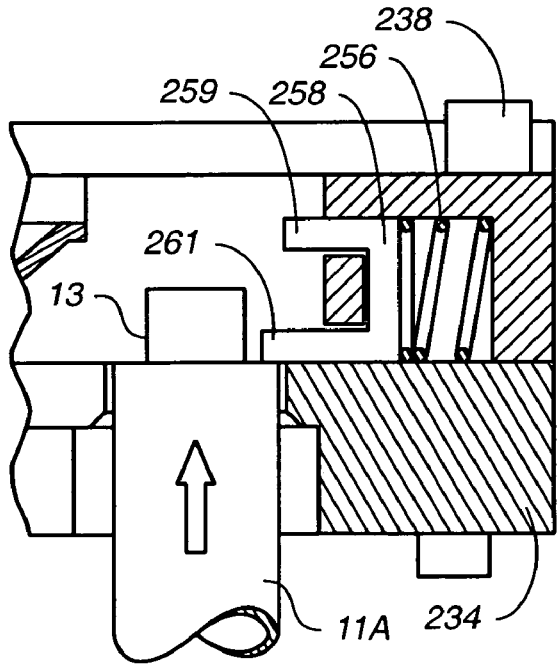
FIG. 7B is a cross section of a portion of an embodiment of the present invention illustrating the firing safety device illustrated in FIG. 7A in a second position.

FIGS. 7A and B illustrate a safety stop designed to prevent the power actuated gun from firing should a fastener assembly not be placed in a firing position. Many power actuated guns have a safety feature such that if a portion of the barrel, for example an inner portion 13, does not contact a sufficiently hard surface, a safety mechanism within the power actuated gun will cause the gun not to fire. Generally, this prevents the gun from firing unless the barrel is placed against a solid surface. However, in most applications, the barrel can be placed against a solid surface without a fastener assembly placed therein and the power actuated gun will still be able to fire. This may result in a dangerous firing of the gun, damage to the plunger of the gun, and at the least a waste of a charge. The embodiment illustrated in FIGS. 7A and B provide a safety feature associated with a track so as to prevent the firing of a power actuated gun should a fastener assembly not be in a firing position. In FIG. 7A, a track is illustrated with a foot 238 placed adjacent a hard surface, not illustrated, and the outer barrel 11A being advanced with an inner safety barrel 13 forced against the plate 14A. The outer barrel 11A is allowed to continue to advance, placing sufficient force on the inner safety barrel 13A to cause the power actuated gun to fire. The fastener plate 14A pushes a detection leg 259 of a stop slide 258 compressing spring 256. The stop leg 261 is therefore clear of the outer barrel 11A. FIG. 7B illustrates operation of the safety feature when a fastener assembly is not positioned in the firing position. When a fastener assembly is not positioned in the firing position, the absence of a plate 14A, illustrated in FIG. 7A, causes the detection leg 259 to move forward or towards the barrel 11A due to the bias of spring 256. The stop leg 261 therefore is moved into position so as to strike the outer barrel 11A as it is advanced in the direction of the barrel on 11A. The stop leg 261 prevents any further advancement of the outer barrel 11A. Accordingly, the inner safety barrel 13 does not contact a hard surface preventing the power actuated gun from firing. Therefore, should the fastener assembly supply run out of the track or should a fastener assembly not be in a firing position for any reason, the safety device illustrated in FIGS. 7A and B will prevent the power actuated gun from firing. Other equivalent safety devices may be used to prevent the unintentional firing of the power actuated gun. For example a stop may be place at other locations. Additionally, should be appreciated that the present invention is inherently safer than prior individually hand loaded power actuated guns. By providing automated feeding the risk of injury to an operator during loading of the barrel directly is substantially reduced or eliminated. Should the power actuated gun misfire during loading, serious injury could result.

FIGS. 8 through 11 illustrate the operation of a control mechanism 41 that takes advantage of the relative movement between a track 12 and the power actuated gun 10. Sliding rods 40A and 40B and springs 42 permit relative movement between an attachment to the power actuated gun 10 and the power actuated gun 10. Long rod 40B may be attached to a control mechanism 41. Generally, the control mechanism 41 may be used to operate any feature of a power actuated gun. However, in this embodiment, the control mechanism 41 operates a charge advancing lever 52 used to advance a charge strip 50. The charge advancing lever 52 has a tab 51 thereon which contacts the charge strip 50. The lever 52 is pivoted at one end by pivot 49. A cam 57 forms a part of the control mechanism 41 and activates or depresses lever 52.

Figure 8:
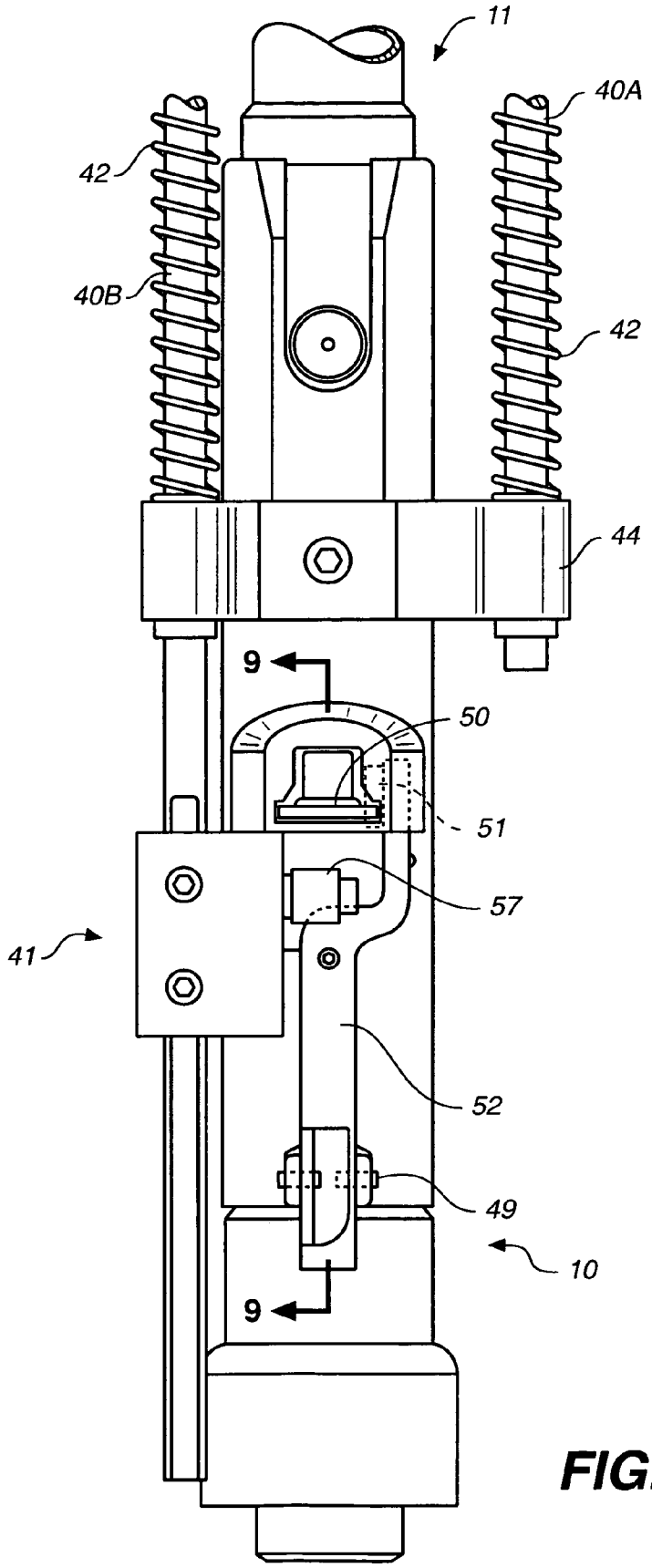
FIG. 8 is a partial elevational view of an embodiment of the present invention illustrating a charge advancing control mechanism.
Figure 9:
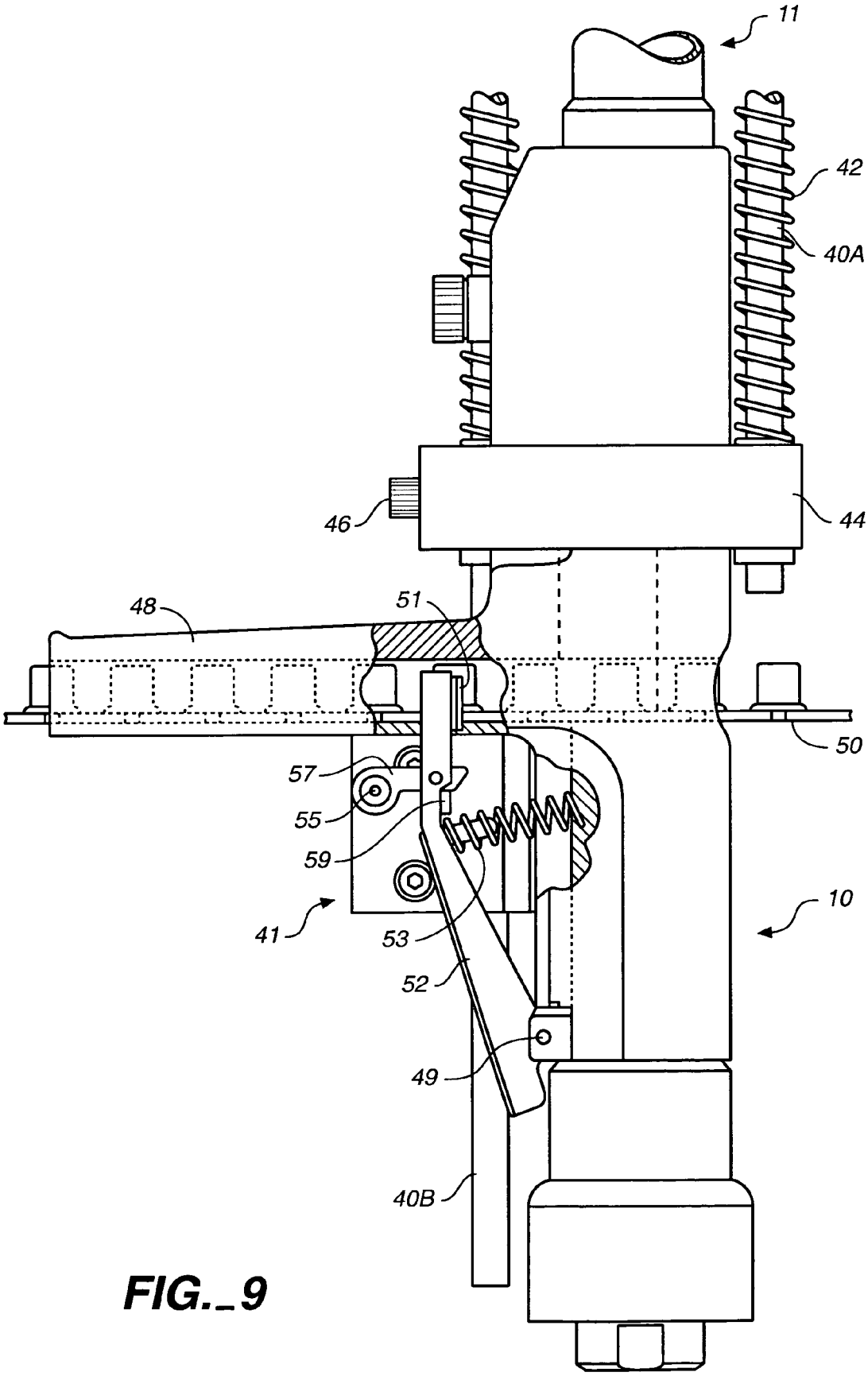
FIG. 9 is a side elevational view of a portion of the present invention illustrating the charge advancing control mechanism illustrated in FIG. 8.

FIG. 9 is a partial cross section taken along line 9—9 in FIG. 8. FIG. 9 more clearly illustrates the operation of the control mechanism 41. A spring 53 is attached to charge advance lever 52, biasing the charge advance lever 52 away from the body of the power actuated gun 10. The cam 57 fits in an opening within a fork of the lever 52. A stop 59 prevents the cam 57 from pivoting on pivot 55.

Figure 10A:
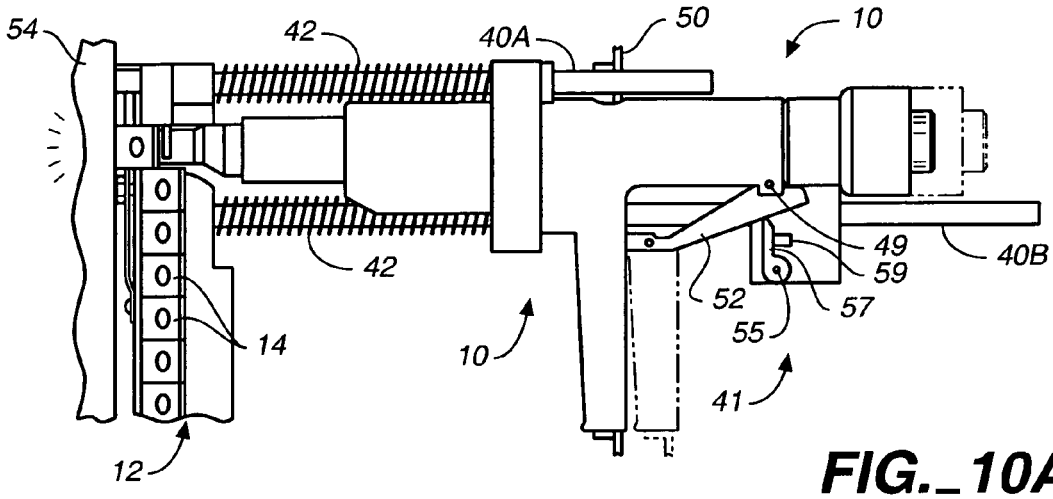
FIG. 10A schematically illustrates an embodiment of the present invention and the charge advancing control mechanism in a first position.
Figure 10B:
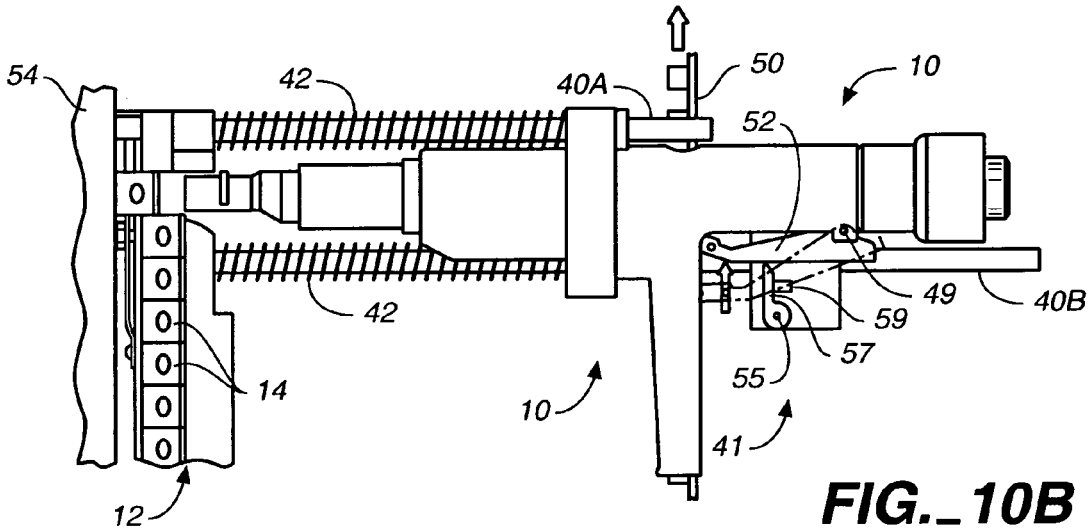
FIG. 10B schematically illustrates the operation of the embodiment of the present invention and the charge advancing control mechanism in a second position.
Figure 10C:
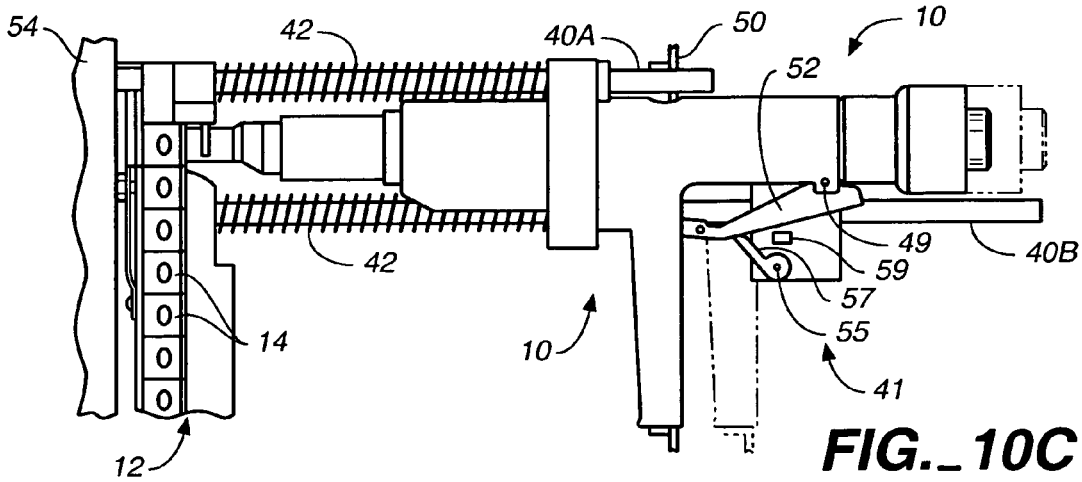
FIG. 10C schematically illustrates the operation of the embodiment of the present invention and the charge advancing control mechanism in a third position.

FIGS. 10A–C schematically illustrate the general operation of the control mechanism 41 and its use advancing a charge strip 50 readying the power actuated gun 10 for a subsequent firing. In FIG. 10A, the power actuated gun 10 is moved forward, causing a fastener assembly in the firing position to be forced against the surface 54. Springs 42 are compressed and the power actuated gun may be fired. This embodiment of the power actuated gun 10 is fired when continuous pressure is applied to the rear of the power actuated gun 10 and the barrel of the power actuated gun 10 is adjacent a hard surface. This embodiment of the power actuated gun 10 is often used on the end of a pole when applying fastener assemblies to a ceiling. However, this embodiment of the power actuated gun requires the charge strip 50 to be advanced to provide sequential firing of the power actuated gun 10. The control mechanism 41 uses the relative motion between the power actuated gun 10 and a track 12 to automate the advancing of the charge strip 50. This makes it unnecessary to bring the power actuated gun 10 down from the end of a pole when the power actuated gun 10 is used in applying multiple fastener assemblies to a ceiling. FIG. 10B illustrates the operation of the control mechanism 41 after a fastener assembly is driven into surface 54. The springs 42 providing a relative movement between the power actuated gun 10 and a track 12. The bias of the springs 42 move the power actuated gun 10 and handle 52 away from the track 12. The cam 57 is forced upward by the stop 59, resulting in the handle 52 being compressed against the body of the power actuated gun 10 as illustrated in the direction of the arrow adjacent the lever 52. The charge strip 50 is thereby advanced as illustrated by the arrow adjacent strip 50. FIG. 10C illustrates operation of the control mechanism 41 when a new fastener assembly is placed in a firing position and the power actuated gun 10 is moved closer to the track 12 compressing springs 42. As the power actuated gun 10 and the attached lever 52 are moved closer to the track 12, the cam 57 is caused to pivot counterclockwise on pivot 55 away from stop 59. The cam 57 slides along the surface of lever 52. Accordingly, lever 52 is not compressed towards the body of the power actuated gun 10. Therefore, the charge strip 50 is not advanced while the barrel of the power actuated gun 10 pushes another fastener assembly away from the track and against the surface 54.

Figure 11A:
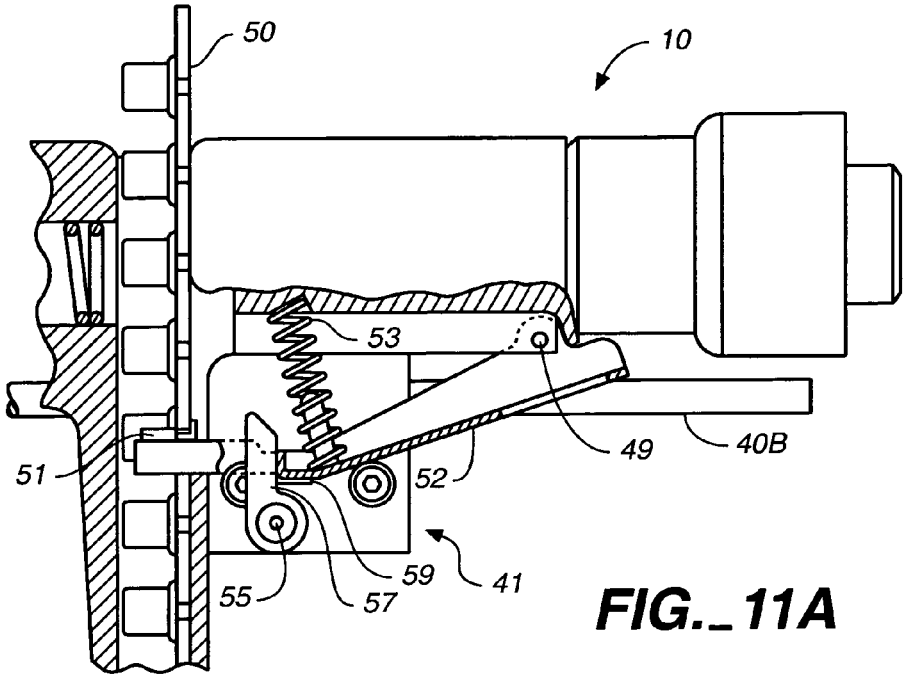
FIG. 11A more clearly illustrates the operation of the charge advancing control mechanism in another first position.
Figure 11B:
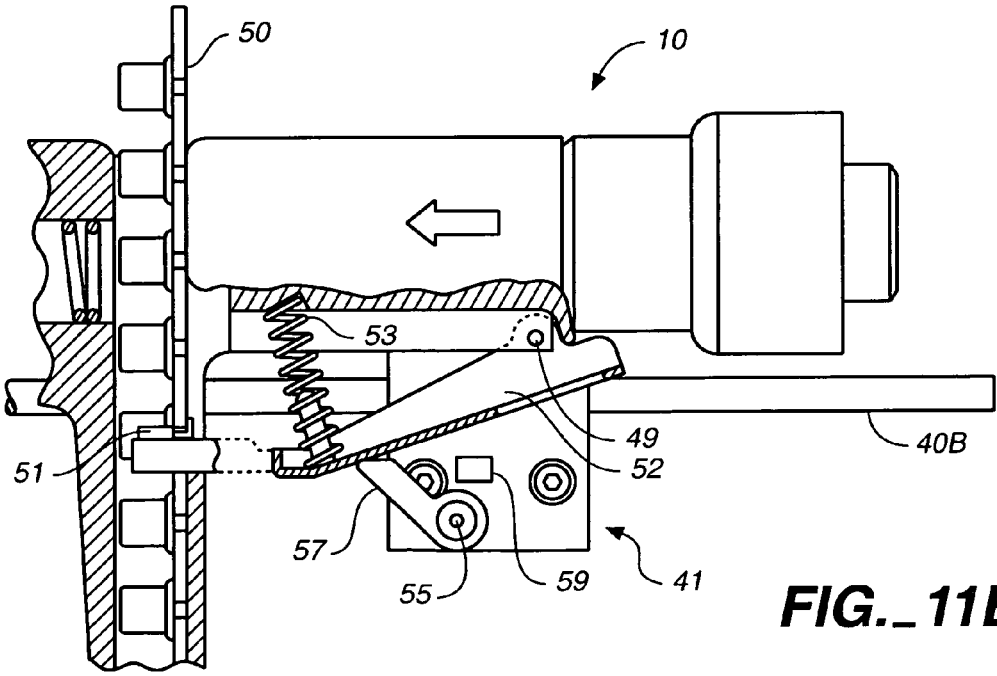
FIG. 11B more clearly illustrates the operation of the charge advancing control mechanism in another second position.
Figure 11C:
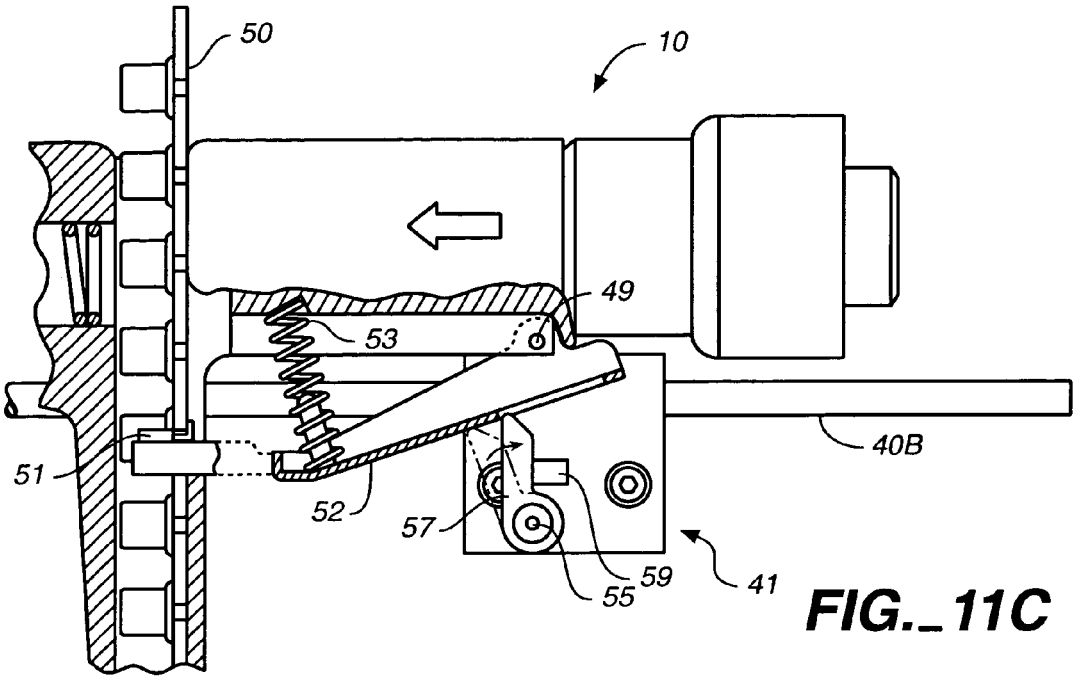
FIG. 11C more clearly illustrates the operation of the charge advancing control mechanism in another third position.
Figure 11D:
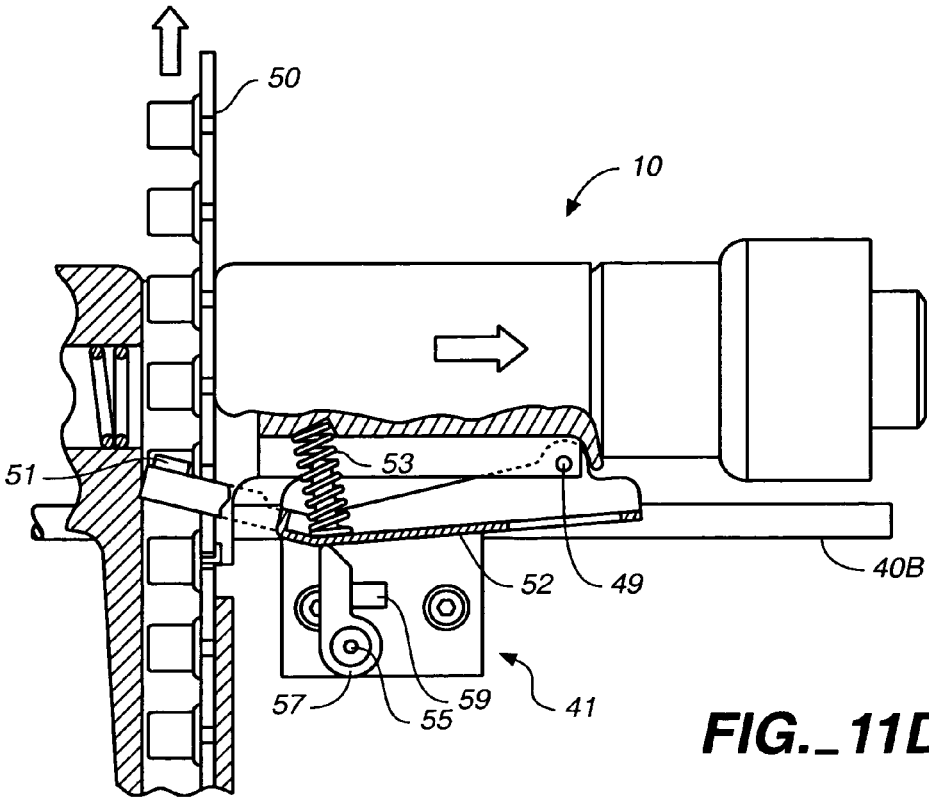
FIG. 11D more clearly illustrates the operation of the charge advancing control mechanism in another fourth position.

FIGS. 11A–D more clearly illustrate the operation of the control mechanism 41. FIG. 11A illustrates the control mechanism 41 in a resting position. The cam 57 extends through an opening in the lever 52. Advancing tab 51 is in position adjacent the charge strip 50. Spring 53 biases the lever 52 away from the body of the power actuated gun 10. FIG. 11B illustrates the operation of the control mechanism 41 as the power actuated gun 10 is moved to the left or in the direction of the arrow on the body of the power actuated gun 10. As the handle 52 is moved with the power actuated gun 10 in the direction of the arrow on the body of power actuated gun 10, the control mechanism 41 attached to the long rod 40B remains stationary. As a result of the contact between the lever 52 and the cam 57, the cam 57 is pivoted counterclockwise on pivot 55 away from stop 59. FIG. 11C illustrates the full advancement of the power actuated gun 10 and the attached lever 52 with the cam 57 having sufficient clearance with the angled lever 52 so as not to depress the lever 52 or compress spring 53. During the movement illustrated by FIGS. 11A–C, the lever 52 has not moved resulting in no advancement of the charge strip 50. FIG. 11D illustrates operation of the control mechanism 41 as the power actuated gun 10 is moved in the direction of the arrow illustrated on the body of the power actuated gun 10. As the attached lever 52 is moved in the direction of the arrow on the body of the power actuated gun 10, cam 57 is forced clockwise against stop 59. This causes the lever 52 to pivot toward the body of the power actuated gun 10 and compressing spring 53. The advancing tab 51 is caused to move with the lever 52 resulting in the charge strip 50 to advance in the direction of the arrow adjacent charge strip 50. Accordingly, in this embodiment of the present invention, the relative motion between an attachment to a power actuated gun, for example a track, and the power actuated gun, results in the ability to control or activate different features on the power actuated gun. Other equivalent features of the power actuated gun may be controlled with the motion created by the power actuated gun.

Figure 12A:
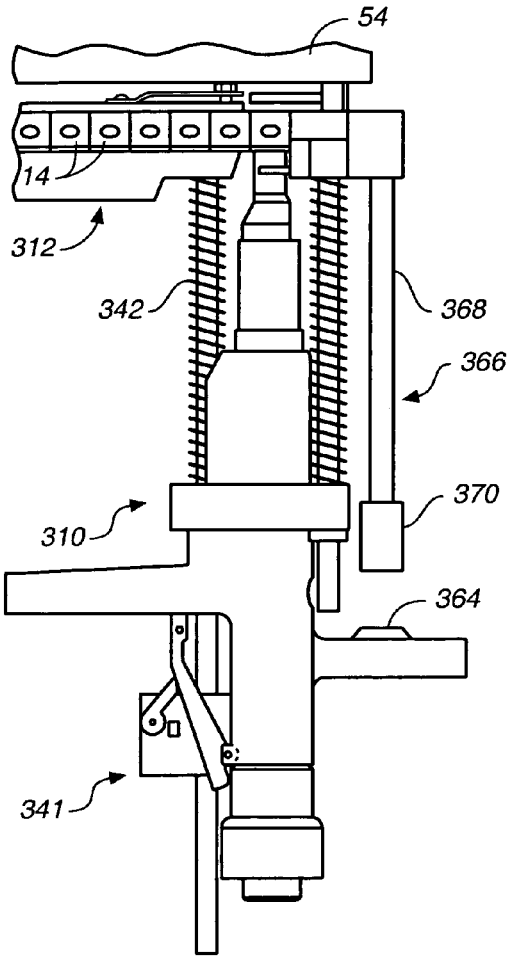
FIG. 12A schematically illustrates the operation of a trigger control mechanism in a first non-firing position.
Figure 12B:
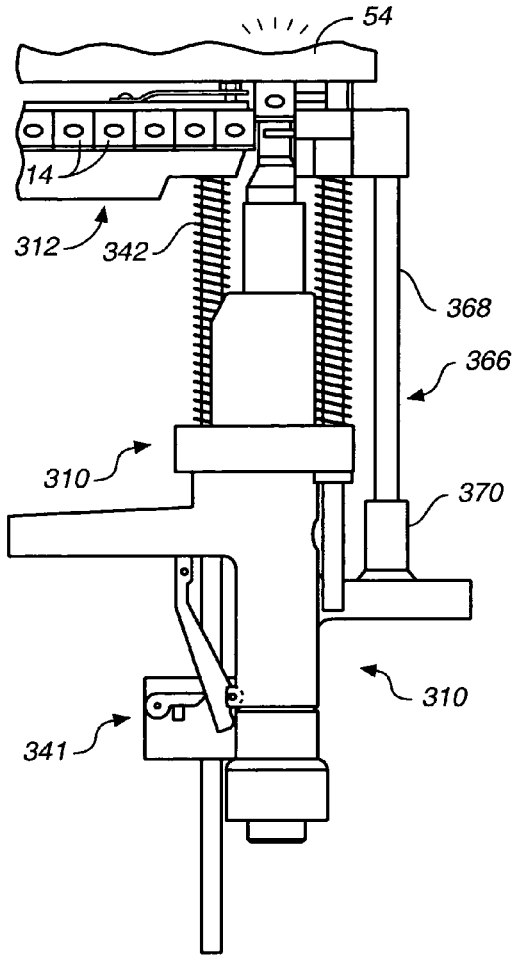
FIG. 12B schematically illustrates the operation of the trigger control mechanism in a second firing position.

FIGS. 12A–B illustrate another type of control mechanism that may be utilized as a result of the relative movement between a track and a power actuated gun. In some power actuated guns, an external trigger must be activated before the gun will fire. In power actuated gun applications utilizing a pole to elevate the power actuated gun to a ceiling, a wire is sometimes used connected to a trigger to fire the gun from a ground location. However, this is often inconvenient and requires the operator to pull a wire mechanism to fire the gun. The embodiment illustrated in FIGS. 12A–B provides a trigger control mechanism that automates the firing of a power actuated gun 310. The power actuated gun 310 has a trigger 364 which must be activated or depressed in order to fire. This embodiment of the power actuated gun 310 may also have a charge advance mechanism 341, similar to that previously illustrated in greater detail. A control rod 368 is attached to a track 312 containing a plurality of fastener assemblies having plates 14. A plunger or activator 370 is attached to the trigger control rod 368. The plunger or activator 370 may be spring loaded to the trigger control rod 368. However, the spring must be sufficiently strong or provide a force greater than that necessary to activate the trigger 364. This assures that any slight variances in distance or travel will not result in a gap between the plunger or activator 370 and the trigger 364, resulting in the power actuated gun 310 not to fire. FIG. 12A illustrates the position of the power actuated gun 310 prior to advancing the power actuated gun 310 towards the track 312 and against the surface 54. FIG. 12B illustrates the positioning of the power actuated gun 310 moved upward adjacent the surface 54 so as to compress springs 342. Accordingly, a fastener assembly is stripped from the track 312 and caused to abut surface 54. The trigger is then activated by the plunger 370 causing the power actuated gun 310 to fire. Accordingly, the embodiment illustrated in FIGS. 12A–B can fully automate the firing of a power actuated gun 310 of the type having a trigger 364. Therefore, in combination with the track 312 and control mechanisms 341 and 366, the power actuated gun 310 may be repeatedly fired without having to lower and adjust or feed the power actuated gun 10. Therefore, when the power actuated gun 310 is placed on a pole and used in a ceiling application, the power actuated gun 310 does not have to be lowered for insertion of a new fastener assembly, advancement of the charge, and a separate lever or cable pulled once in position to fire. The present invention therefore greatly facilitates the rapid firing of multiple rounds or charges to very rapidly sequentially drive fastener assemblies.

Figure 13:
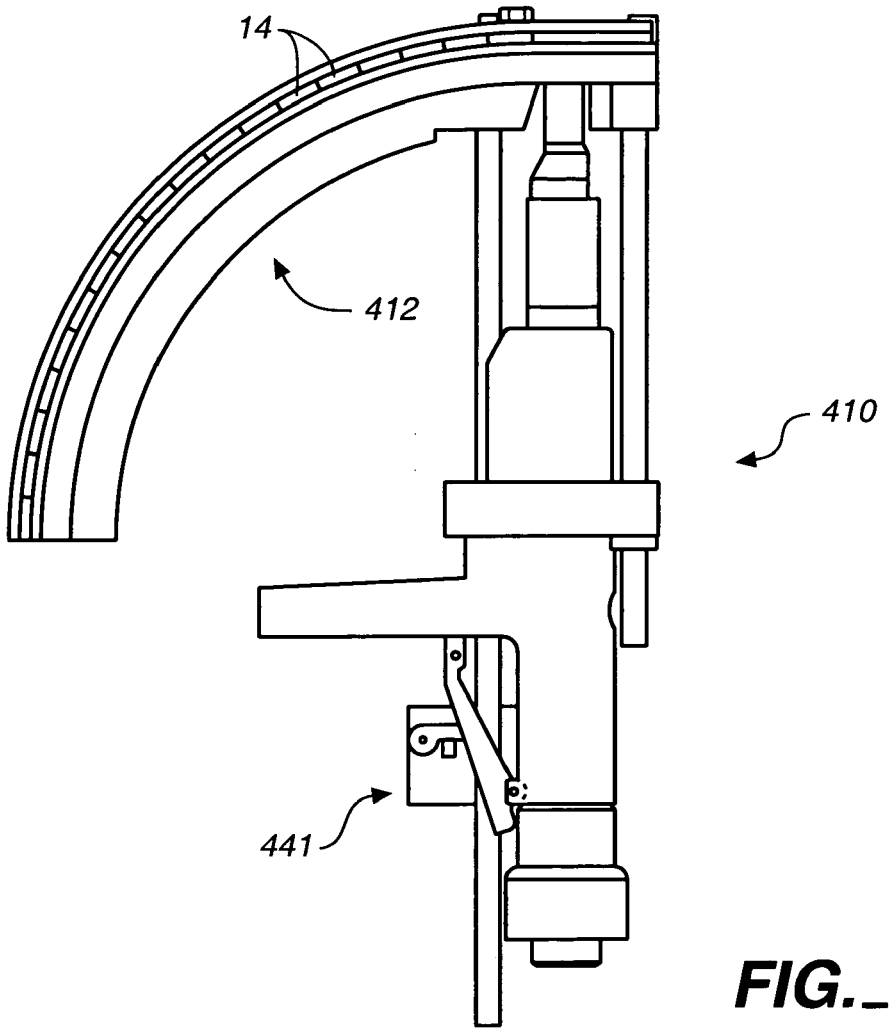
FIG. 13 schematically illustrates an embodiment of the present invention having a curved fastener feeding track.

FIG. 13 illustrates another embodiment of a power actuated gun 410 having a control mechanism 441 and a curved track 412. The curved track 412 operates substantially similarly to the previously described linear tracks in holding plates 14 of a fastener assembly. However, the curved track 412 makes the power actuated gun 410 more compact and permitting the invention to fit in tighter places than if the track was not curved.

Figure 14:
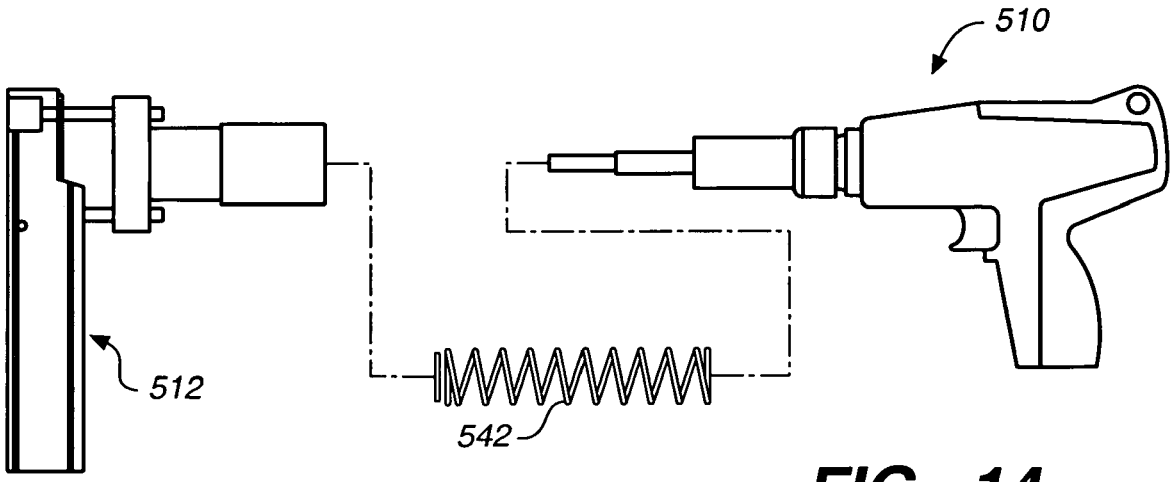
FIG. 14 schematically illustrates in an exploded view another means for moving the gun relative to an attachment or track.

FIG. 14 illustrates another embodiment of a power actuated gun 510 showing a different means for moving a track 512 relative to the power actuated gun 510. A single concentric spring 542 may be placed over the barrel of the power actuated gun 510 and within a single cylinder attached to a track 512.

Accordingly, it should be appreciated that the present invention may encompass a variety of different embodiments, only several of which have been illustrated in detail. It will be clear that the principles of the present invention can be applied to many different structures without departing from the spirit and scope of the invention. The present invention provides the automation of a power actuated gun that saves considerable time. Fastener assemblies can rapidly be positioned and driven with the worker or operator taking virtually no time between firing to reload a fastener assembly or advance the charge.

What is claimed is:

1. A power actuated gun system comprising:

a power actuated gun having a barrel;

a fastener feeding track attached to said power actuated gun, the fastener feeding track being movable with respect to the barrel of the power actuated gun;

a plurality of fastener assemblies received in said fastener feeding track, said fastener assemblies each comprising a stud held within a fastener plate;

means, attached to said fastener feeding track, for holding a first fastener assembly in a firing position over the barrel whereby the fastener plate of the first fastener assembly is positioned outside of the barrel and the stud enters the barrel when the barrel moves towards the fastener feeding track; and a fastener loading control attached to said fastener feeding track, said fastener loading control selectively preventing movement of a second fastener assembly which will next move into the firing position over the barrel.

2. A power actuated gun system as in claim 1 wherein said means for holding a first fastener assembly in a firing position comprises:

a plurality of guides contacting the first fastener assembly on at least two adjacent sides.

3. A power actuated gun system as in claim 1 wherein:

each of said fastener plates of said fastener assemblies has an edge that is in contact with a fastener plate of an adjacent fastener assembly.

4. A power actuated gun system as in claim 1 wherein:

said means, attached to said fastener feeding track, for holding a first fastener assembly in a firing position over the barrel comprises a first guide attached to said fastener feeding track and positioned to contact a fastener plate of the first fastener assembly.

5. A power actuated gun system as in claim 1 wherein:

when the barrel is clear of the adjacent second fastener assembly said fastener loading control permits movement of the second fastener assembly.

6. A power actuated gun system comprising:

a power actuated gun having a barrel;

a fastener feeding track attached to said power actuated gun;

means, attached to said fastener feeding track, for holding a first fastener assembly in a firing position over the barrel; and a fastener loading control attached to said fastener feeding track, said fastener loading control selectively preventing movement of a second fastener assembly adjacent the first fastener assembly in the firing position over the barrel, whereby when the barrel is clear of the adjacent second fastener assembly said fastener loading control permits movement of the second fastener assembly, wherein said fastener loading control comprises a spring attached at one end to said fastener feeding track;

a contact attached to the other end of said spring;

an extension attached to said contact, said extension positioned to contact a fastener assembly having a plate and an attached stud, whereby movement of the fastener assembly is prevented until released by said extension.

7. A power actuated gun system as in claim 6 wherein:

said extension has a space adapted to receive an end of the stud.

8. A power actuated gun system comprising:

a power actuated gun having a barrel;

a fastener feeding track attached to said power actuated gun;

means, attached to said fastener feeding track, for holding a first fastener assembly in a firing position over the barrel; and a fastener loading control attached to said fastener feeding track, said fastener loading control selectively preventing movement of a second fastener assembly adjacent the first fastener assembly in the firing position over the barrel, whereby when the barrel is clear of the adjacent second fastener assembly said fastener loading control permits movement of the second fastener assembly;

wherein said fastener loading control comprises:

a foot attached to said fastener feeding track, whereby said foot is capable of contacting a surface;

a loading control spring attached at one end to said fastener feeding track;

a contact attached to the other end of said loading control spring, said contact biased by said loading control spring in a direction away from said fastener feeding track and beyond said foot; and an extension attached to said contact extending towards said fastener feeding track, said extension having a space therein adapted to receive a pointed end of a stud attached to the second fastener assembly adjacent to the first fastener assembly in the firing position, whereby movement of the second fastener assembly adjacent the first faster assembly is prevented until being released by said extension.

9. A power actuated gun system comprising:

a power actuated gun having a barrel;

a fastener feeding track attached to said power actuated gun;

means, attached to said fastener feeding track, for holding a first fastener assembly in a firing position over the barrel; and a fastener loading control attached to said fastener feeding track, said fastener loading control selectively preventing movement of a second fastener assembly adjacent the first fastener assembly in the firing position over the barrel, wherein said fastener loading control comprises, a spring attached at one end to said fastener feeding track;

a contact attached to the other end of said spring;

an extension attached to said contact, said extension positioned to contact a fastener assembly having a plate and an attached stud and having a space adapted to receive an end of the stud and wherein the space is axially aligned with the stud, whereby movement of the fastener assembly is prevented until released by said extension and when the barrel is clear of the adjacent second fastener assembly said fastener loading control permits movement of the second fastener assembly.

10. A power actuated gun system comprising:

a power actuated gun having a barrel;

a fastener feeding track attached to said power actuated gun capable of holding a plurality of fastener assemblies adjacent each other, one of the plurality of fastener assemblies being held in a firing position;

a foot attached to said fastener feeding track, whereby said foot is capable of contacting a surface;

a first spring guide attached to said fastener feeding track and positioned to contact a first edge of the one of the plurality of fastener assemblies being held in a firing position, the first edge being positioned opposite an edge contacting an adjacent fastener assembly;

a second spring guide attached to said fastener feeding track and positioned to contact a second edge of the one of the plurality of fastener assemblies being held in the firing position, the second edge being adjacent the first edge;

a loading control spring attached at one end to said fastener feeding track;

a contact attached to the other end of said loading control spring, said contact biased by said loading control spring in a direction away from said fastener feeding track and beyond said foot; and an extension attached to said contact extending towards said fastener feeding track, said extension having a space therein adapted to receive a pointed end of a stud attached to the adjacent fastener assembly, the space being axially aligned with the stud, whereby when said fastener feeding track is advanced towards the surface, said contact hits the surface and is caused to move towards the stud attached to the adjacent fastener assembly adjacent the one of the plurality of fastener assemblies being held in the firing position preventing the adjacent faster assembly from advancing into a firing position after the one of the fastener assemblies being held in the firing position has been driven into the substrate.

* * * * *